US012631177B2

(12) United States Patent
Zhang

(10) Patent No.: US 12,631,177 B2
(45) Date of Patent: May 19, 2026

(54) HIGH-PRESSURE WATER PUMP LUBRICATED BY WATER OR AQUEOUS SOLUTION

(71) Applicant: Fan Zhang, Beijing (CN)

(72) Inventor: Fan Zhang, Beijing (CN)

(73) Assignee: Shanghai Wave Rider Fluid Technology Co. Ltd., Shanghai (CN)

( * ) Notice: Subject to any disclaimer, the term of this patent is extended or adjusted under 35 U.S.C. 154(b) by 24 days.

(21) Appl. No.: 18/271,299

(22) PCT Filed: Dec. 21, 2021

(86) PCT No.: PCT/CN2021/140068
§ 371 (c)(1),
(2) Date: Jul. 7, 2023

(87) PCT Pub. No.: WO2023/115328
PCT Pub. Date: Jun. 29, 2023

(65) Prior Publication Data

US 2024/0301876 A1 Sep. 12, 2024

(51) Int. Cl.
*F04B 53/18* (2006.01)
*F04B 9/04* (2006.01)

(52) U.S. Cl.
CPC ..... *F04B 53/18* (2013.01); *F04B 9/042* (2013.01)

(58) Field of Classification Search
CPC ..... F04B 53/13; F04B 9/042
See application file for complete search history.

(56) References Cited

U.S. PATENT DOCUMENTS 6,183,212 B1 * 2/2001 Djordjevic ..... F04B 1/0426 417/462
2004/0179950 A1 * 9/2004 Kuroda ..... F02M 59/102 417/244

(Continued)

FOREIGN PATENT DOCUMENTS

CN 2619066 Y 6/2004
CN 1542295 A 11/2004

(Continued)

OTHER PUBLICATIONS

English Translation of CN 104696212B (Year: 2017).*

(Continued)

*Primary Examiner* — Connor J Tremarche
(74) *Attorney, Agent, or Firm* — Westbridge IP LLC

(57) ABSTRACT

A high-pressure water pump lubricated by water or aqueous solution is provided, which includes a driving mechanism, a shell, a rebound structure, at least one plunger and a plunger cavity. The driving mechanism includes a main shaft and at least one eccentric structure arranged on the main shaft, a thrust structure is sleeved on the outer side of each eccentric structure, the thrust structure and the eccentric structure rotate relative to each other, and constitute the first sliding friction pair. The eccentric structure and the thrust structure are located in the shell, and spaces in the shell are filled with water or an aqueous solution that enters the first sliding friction pair. When the eccentric structure is rotated, the thrust structure pushes the plunger to move in the plunger cavity. The plunger moves in the plunger cavity under the rebound force of the rebound structure.

9 Claims, 5 Drawing Sheets

(56) References Cited

U.S. PATENT DOCUMENTS

| | | | | |
|---|---|---|---|---|
| 2008/0232189 | A1* | 9/2008 | Gandini | F04B 53/164 366/267 |
| 2012/0201706 | A1 | 8/2012 | Liu et al. | |
| 2014/0026843 | A1* | 1/2014 | Florea | F16C 32/0402 123/198 R |
| 2014/0356210 | A1* | 12/2014 | Ahn | F04C 29/0071 418/55.5 |
| 2015/0184556 | A1* | 7/2015 | Yamada | F01L 1/053 123/90.15 |
| 2016/0091021 | A1* | 3/2016 | Yamamoto | F16C 33/121 384/276 |
| 2018/0156152 | A1* | 6/2018 | Natori | F02M 59/36 |

FOREIGN PATENT DOCUMENTS

| | | | |
|---|---|---|---|
| CN | 203098173 | U | 7/2013 |
| CN | 104696212 | A | 6/2015 |
| CN | 104728080 | A | 6/2015 |
| CN | 204511865 | U | 7/2015 |
| CN | 104847612 | A | 8/2015 |
| CN | 105240237 | A | 1/2016 |
| CN | 104696212 | B * | 1/2017 |
| CN | 108266429 | A | 7/2018 |
| JP | S5655781 | U | 5/1981 |
| JP | H03102070 | U | 10/1991 |
| JP | 2005127225 | A | 5/2005 |
| JP | 2013155627 | A | 8/2013 |

OTHER PUBLICATIONS

International Search Report for application No. PCT/CN2021/140068.

First Office Action issued in counterpart Japanese Patent Application No. 2024-538104, dated Aug. 5, 2025.

* cited by examiner

HIGH-PRESSURE WATER PUMP LUBRICATED BY WATER OR AQUEOUS SOLUTION

CROSS-REFERENCE TO RELATED APPLICATION

This patent application is the national phase of PCT/CN2021/140068, filed with the China National Intellectual Property Administration on Dec. 21, 2021, the disclosure of which is incorporated by reference herein in its entirety as part of the present application.

TECHNICAL FIELD

The present disclosure relates to the technical field of high-pressure water pumps, in particular to high-pressure water pumps lubricated by water or aqueous solution.

BACKGROUND ART

The high-pressure water pump is used for producing high-pressure water. As a core component, the high-pressure water pump is widely applied to the fields of high-pressure cleaning, high-pressure mist generation, fine mist fire extinguishing, seawater desalination, high-pressure deburring and the like.

The high-pressure water pumps widely used at present are reciprocating pumps and water-lubricated axial plunger pumps.

The reciprocating pump has a long history, is widely used in the production of high-pressure water, and is mainly composed of a crankshaft, connecting rods, crossheads, plungers and other components. Lubricating oil is used for lubricating the power end, and a sealing ring is needed for sealing pressurized water and isolating water and lubricating oil. The main problems of this type of pump are that: the lubricating oil needs to be replaced regularly, and the lubricating oil will pollute the environment, and the sealing ring has short service life and is troublesome to replace.

In the 1990s, a commercial water-lubricated axial plunger pump is successfully provided by taking Danfoss as a representative. Compared with the reciprocating pump, the water-lubricated axial plunger pump has the advantages of environmental protection, high energy efficiency and the like. The main moving part is supported by hydrostatic pressure, and the maximum pressure output of 16 MPa is realized. In addition, CN105240237A discloses a water-lubricated plunger pump. The main problems of these water-lubricated high-pressure pumps are that: a large number of design elements of hydrostatic support are adopted, higher pressure is difficult to be realized due to the influence of high-pressure water leakage, and simultaneously, the hydrostatic support improves the structural complexity, is easily damaged by the pollutant, and has a high requirement for water filtration.

The high-pressure water pump realized by the power-end water lubrication technology has environmental protection and high efficiency, and is undoubtedly an important development direction of the high-pressure water pump. However, the viscosity of water is low, the lubricity of traditional materials is poor, the design and matching of friction pairs are difficult, and the high-performance materials suitable for water are limited, so that the water-lubricated high-pressure water pump with higher pressure, strong environmental adaptability and good economy is not yet commercially realized.

SUMMARY

The present disclosure aims to provide a high-pressure water pump lubricated by water or aqueous solution, which has a simple structure and solves the problems that the existing water-lubricated high-pressure water pump is easily damaged by pollutants and has low pressure output.

In order to achieve the purpose, the present disclosure provides the following scheme.

The present disclosure provides a high-pressure water pump lubricated by water or aqueous solution, including a driving mechanism, a shell, a rebound structure, at least one plunger and a plunger cavity. The driving mechanism includes a main shaft and at least one eccentric structure arranged on the main shaft, a thrust structure is sleeved on the outer side of each eccentric structure, the thrust structure and the eccentric structure rotate relative to each other, and the thrust structure and the eccentric structure constitute the first sliding friction pair. The eccentric structure and the thrust structure are both located in the shell, and spaces in the shell in which the eccentric structure and the thrust structure are respectively located are used to be filled with water or an aqueous solution simultaneously, and the water or aqueous solution enters the first sliding friction pair in the shell. When the eccentric structure is rotated, the thrust structure rolls on a contact surface between the thrust structure and the plunger and pushes the plunger to move in the plunger cavity to pressurize the water or aqueous solution; and the plunger moves in the plunger cavity under the rebound force of the rebound structure to suck in water or aqueous solution.

Preferably, the outer edge curve of the cross section of the thrust structure perpendicular to the axis of the main shaft includes a first curve and a second curve, the perpendicular distance from a point on the first curve to the axis of the main shaft gradually increases from one end of the first curve to another end of the first curve, and the perpendicular distance from a point on the second curve to the axis of the main shaft gradually decreases from one end of the second curve, which is connected to another end of the first curve, to another end of the second curve which is connected to one end of the first curve.

Preferably, the first anti-friction layer is provided on the outer surface of the eccentric structure and/or the inner surface of the thrust structure; and the first anti-friction layer is made of plastic.

Preferably, the plunger includes a plunger body, one end of the plunger body extends into the plunger cavity, the plunger body and the plunger cavity constitute the second friction pair, a second anti-friction layer is fixed on the outer surface of the plunger body and/or the inner surface of the plunger cavity; and the second anti-friction layer is made of plastic.

Preferably, the high-pressure water pump lubricated by water or aqueous solution includes at least two thrust structures and at least two plungers, the thrust structures and the plungers correspond to each other one by one, and the plungers are located at one side of the main shaft.

Preferably, the eccentric structure includes a main body and a sleeve connection structure, the sleeve connection structure is sleeved on the main body, and a gap is provided between the sleeve connection structure and the main body.

Preferably, the sleeve connection structure includes at least two sleeve connection bodies which are sequentially sleeved, a gap is provided between the innermost sleeve connection body and the main body, and a gap is provided between adjacent sleeve connection bodies.

Preferably, the thrust structure includes at least two thrust bodies which are sequentially sleeved, an innermost thrust body is sleeved on the eccentric structure, a gap is arranged between the innermost thrust body and the eccentric structure, and a gap is arranged between the adjacent thrust bodies.

Preferably, the high-pressure water pump lubricated by water or aqueous solution further includes a tappet cavity. The plunger includes a plunger body and a tappet, the tappet slides in the tappet cavity, the tappet and the tappet cavity constitute the third friction pair, the outer surface of the tappet and/or the inner surface of the tappet cavity are/is fixed with a third anti-friction layer, the third anti-friction layer is made of plastic; the thrust structure pushes the tappet to move in the tappet cavity, the tappet transmits the force of the thrust structure to the plunger body, so that the plunger body moves in the plunger cavity and realizes a pressure boost to the water or aqueous solution.

Preferably, the plunger further includes a first plunger body, the first plunger body is arranged on one side of the plunger body, the first plunger body is in contact with the thrust structure, and the first plunger body and the plunger body are made of different materials.

Compared with the prior art, the present disclosure has the following technical effects.

In the present disclosure, the driving mechanism does not contain a hydrostatic support, and through the matching of a suitable material of the first friction pair, the first friction pair of the driving mechanism mainly reduces friction through the hydrodynamic pressure lubrication effect generated by the mutual rotation of the eccentric structure and the thrust structure. The low-friction rolling contact between the thrust structure and the plunger pushes the plunger to pressurize the water or aqueous solution. These key structures are simple to implement and have no flow loss, so that the high-pressure water pump can achieve higher pressure and volumetric efficiency, and the pollution resistance is also obviously improved.

BRIEF DESCRIPTION OF THE DRAWINGS

In order to more clearly illustrate the embodiments of the present disclosure or the technical solutions in the prior art, the drawings required in the embodiments will be briefly described below, it is obvious that the drawings in the following description are only some embodiments of the present disclosure, and it is obvious for those skilled in the art that other drawings can be obtained according to the drawings without creative efforts.

Figure 1:
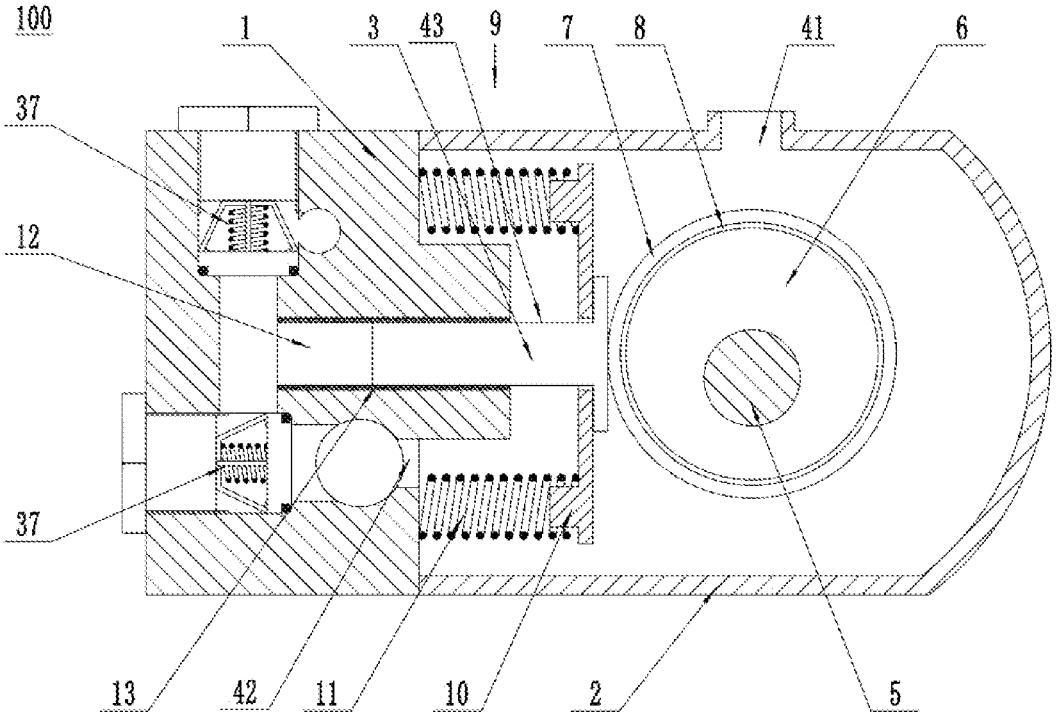
FIG. 1 is a schematic diagram of the internal structure (embodiment one) of the high-pressure water pump lubricated by water or aqueous solution according to the present disclosure.

Numerals in the drawings: 100—high-pressure water pump lubricated by water or aqueous solution, 1—liquid cylinder body, 2—shell, 3—plunger body, 4—driving mechanism, 5—main shaft, 6—cam, 7—thrust structure, 8—first anti-friction layer, 9—rebound structure, 10—first baffle, 11—first elastic element, 12—plunger cavity, 13—second anti-friction layer, 14—first tappet, 15—first tappet cavity, 16—third anti-friction layer, 17—ball head rod, 18—first ball head, 19—first ball socket, 20—second ball head, 21—second ball socket, 22—second tappet, 23—second tappet cavity, 25—third elastic element, 26—boss, 29—bearing, 30—second baffle, 31—second elastic element, 32—eccentric structure, 33—main body, 34—sleeve connection structure, 35—connecting rod journal, 36—crank, 37—one-way valve, 38—thrust body, 39—stop ring, 40—first plunger body, 41—water inlet of shell, 42—water inlet of liquid cylinder body, 43—plunger, 44—first curve, 45—second curve, 47—sleeve connection body, 48—tappet cavity, 49—tappet.

DETAILED DESCRIPTION OF THE EMBODIMENTS

The technical solutions in the embodiments of the present disclosure will be clearly and completely described below with reference to the drawings in the embodiments of the present disclosure, and it is obvious that the described embodiments are only a part of the embodiments of the present disclosure, and not all of the embodiments. All other embodiments, which can be obtained by a person skilled in the art without inventive effort based on the embodiments of the present disclosure, are within the scope of the present disclosure.

The present disclosure aims to provide a high-pressure water pump with a power section lubricated by water or aqueous solution, which has a simple structure and solves the problems that the existing water-lubricated high-pressure water pump is easily damaged by pollutants and has low pressure output.

In order to make the aforementioned objects, features and advantages of the present disclosure more comprehensible, the present disclosure is described in detail with reference to the accompanying drawings and the detailed description thereof.

Embodiment One

Figure 2:
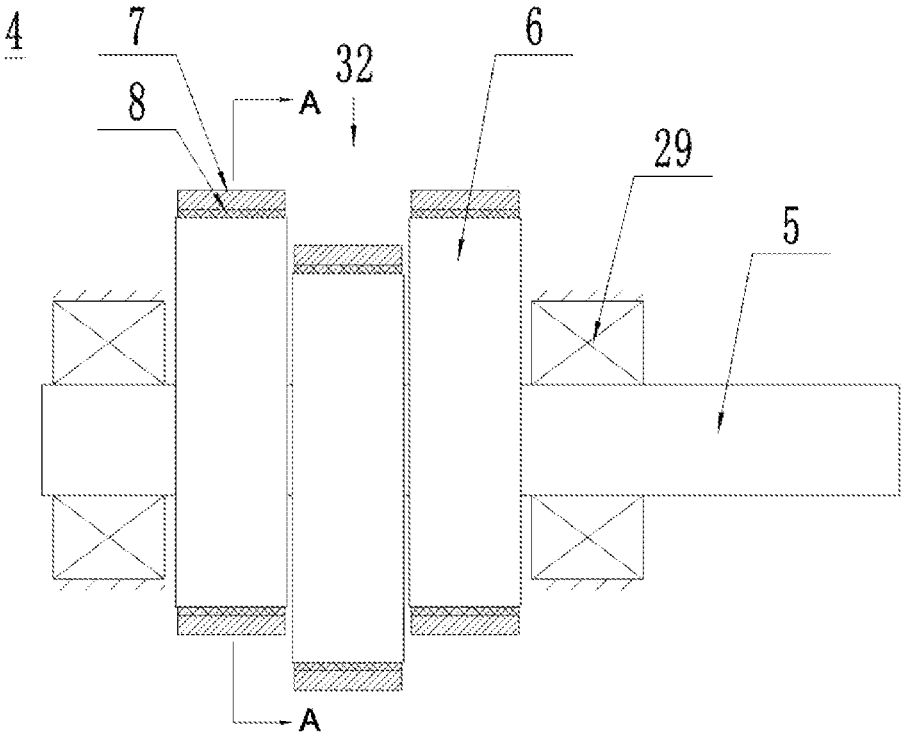
FIG. 2 is a first schematic view of the driving mechanism (embodiment one) according to the present disclosure.
Figure 3:
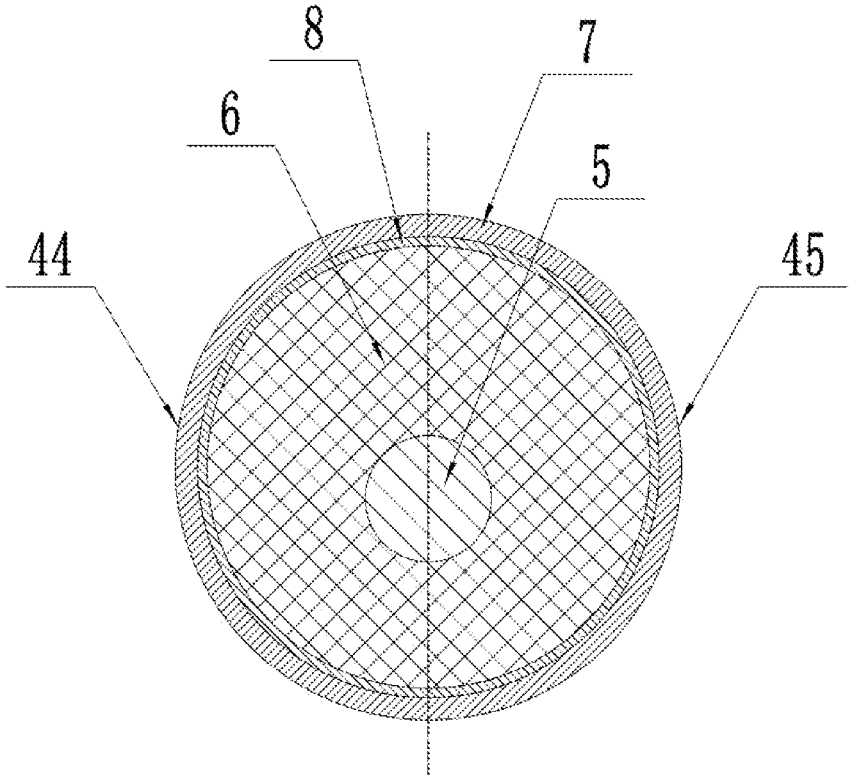
FIG. 3 is a cross-sectional view A-A of FIG. 2 (embodiment one).

As shown in FIGS. 1-3, this embodiment provides a high-pressure water pump lubricated by water or aqueous solution 100, including a driving mechanism 4, a shell 2, a rebound structure 9, a liquid cylinder body 1, at least one plunger 43 and a plunger cavity 12. The liquid cylinder body 1 is also called the pump head, has the same function as the liquid cylinder body of the existing reciprocating pump, and is one of the parts mainly bearing hydraulic pressure in the pump. High and low pressure fluid passages and one-way valves 37 are arranged in the liquid cylinder body 1, one plunger 43 corresponds to one suction valve and one discharge valve to realize the distribution of fluid, thereby realizing the inflow of low-pressure water and the output of high-pressure water. The plunger cavity 12 can be arranged on the liquid cylinder body 1 or the shell 2, and the liquid cylinder body 1 can be integrally processed and formed or can be combined by multiple components. The shell 2 is fixedly connected to a right end of the liquid cylinder body 1, and the liquid cylinder body 1 and the shell 2 are detachably connected or integrally formed. The shell 2 may also be formed by combining and fixing multiple parts. The driving mechanism 4 includes a main shaft 5 and at least one eccentric structure arranged on the main shaft 5, and in this embodiment, the eccentric structure is a cam 6, preferably in the form of an eccentric wheel. A thrust structure 7 is sleeved on the outer side of each cam 6, the thrust structure 7 and the cam 6 can rotate relative to each other, and the thrust structure 7 and the cam 6 constitute the first sliding friction pair. The outer edge curve of the cross section of the thrust structure 7 perpendicular to the axis of the main shaft 5 includes a first curve 44 and a second curve 45, the perpendicular distance from a point on the first curve 44 to the axis of the main shaft 5 gradually increases from one end of the first curve 44 to the other end of the first curve 44, and the perpendicular distance from a point on the second curve 45 to the axis of the main shaft 5 gradually decreases from one end of the second curve 45 connected to the other end of the first curve 44 to the other end of the second curve 45 connected to one end of the first curve 44.

The cam 6 and the thrust structure 7 are both located in the shell 2, and spaces in the shell in which the cam 6 and the thrust structure 7 are located is also used to fill water or an aqueous solution, and the water or aqueous solution can enter the shell 2 so that the lubrication and heat dissipation of the first sliding friction pair can be improved through the water or aqueous solution. The left end of each plunger 43 is located in the liquid cylinder body 1, the right end of each plunger 43 is in contact with the thrust structure 7, and the plunger 43 is provided with the rebound structure 9. One end of the main shaft 5 is connected with a power equipment (such as a motor), when the main shaft 5 drives the cam 6 to rotate, the thrust structure 7 pushes the plunger 43 to move in the plunger cavity 12 of the liquid cylinder body 1 towards the direction of the liquid cylinder body 1 while rolling against the contact surface of the plunger 43 and the thrust structure 7, so that the pressurization of the water or aqueous solution is realized, and the water or aqueous solution is discharged. Then, through the action of the rebound structure 9, it is ensured that during the return stroke of the plunger 43, the plunger 43 keeps contact with the thrust structure 7 and the water is sucked.

In this embodiment, the first anti-friction layer 8 is provided on the outer surface of the cam 6 and/or the inner surface of the thrust structure 7. The first anti-friction layer 8 can be specifically fixed with the cam 6 or the thrust structure 7 through bonding and interference fit, or can be directly molded on the surface by processes such as direct injection molding and spraying, and the water or aqueous solution enters the first sliding friction pair to generate a fluid dynamic pressure lubrication effect.

The first anti-friction layer 8 is made of plastic, preferably thermoplastic materials, such as polyether ether ketone, polyphenylene sulfide, polyamide, polyarylene ether, etc., and the tribological properties can be effectively improved by adding fiber, graphite, polytetrafluoroethylene, etc. into the plastic.

In this embodiment, the cam 6 and the main shaft 5 may be manufactured as an integral part, or may be manufactured in separate parts and assembled and fixed, so that the cam 6 and the main shaft 5 rotate at the same time. Each thrust structure 7 is sleeved on a corresponding cam 6. In this embodiment, three cams 6 are arranged on the main shaft 5, each cam 6 pushes one plunger 43 to pressurize the water or aqueous solution, and the three cams 6 are 120 degrees out of phase with each other in the rotational direction. When only one plunger 43 is pushed by a corresponding thrust structure 7, the friction characteristic between the corresponding thrust structure 7 and the plunger 43 is mainly rolling friction. Conversely, when a plurality of plungers 43 are pushed by the thrust structures 7, the friction between the thrust structures 7 and the plungers 43 may be mainly sliding friction. In the water environment condition, the lubricating property is poor, and the structure arrangement that the thrust structures 7 and the plungers 43 correspond to each other one by one is adopted, so that the structure has important significance for reducing the wear caused by friction in the power system and prolonging the service life of the structure.

Furthermore, the plunger bodies 3 are all arranged on one side of the main shaft 5, so that the structure can be simplified, and the manufacture is convenient.

In this embodiment, the rebound structure 9 includes a first baffle 10 and a first elastic element 11, the first baffle 10 is fixed to the right end of the plunger body 3, one end of the first elastic element 11 abuts against the liquid cylinder body 1, and the other end of the first elastic element 11 abuts against the first baffle 10.

The plunger 43 may be constructed by a single piece or a combination of multiple pieces, and in this embodiment, the plunger 43 includes a plunger body 3. One end of the plunger body 3 extends into the plunger cavity 12 of the liquid cylinder body 1, the plunger body 3 and the plunger cavity 12 constitute the second friction pair, a gap of 1-30 μm is arranged in the second friction pair, the gap ensures that the plunger body 3 moves smoothly in the plunger cavity 12 and prevents high-pressure fluid in the plunger cavity 12 from leaking to a low-pressure end at the same time, and the water or aqueous solution plays a role in lubricating the second friction pair in the gap while taking away the friction heat.

In this embodiment, a second anti-friction layer 13 is fixed on an outer surface of the plunger body 3 and/or an inner surface of the plunger cavity 12. The second anti-friction layer 13 is made of plastic, preferably thermoplastic materials, such as polyether ether ketone, polyphenylene sulfide, polyamide, polyarylene ether, etc., and the tribological properties can be effectively improved by adding fiber, graphite, polytetrafluoroethylene, etc. into the plastic.

In this embodiment, the second anti-friction layer 13 may be fixed to the outer surface of the plunger body 3 or the inner surface of the plunger cavity 12 by bonding or interference fit, or may be directly formed on the surface of the second friction pair by injection molding or spraying.

In this embodiment, the drive mechanism 4 is rotatably connected within the shell 2 by means of a bearing 29.

This embodiment has a simple structure, no lubricating oil, convenient maintenance, and can achieve a pressure output exceeding 30 MPa.

Embodiment Two

Figure 4:
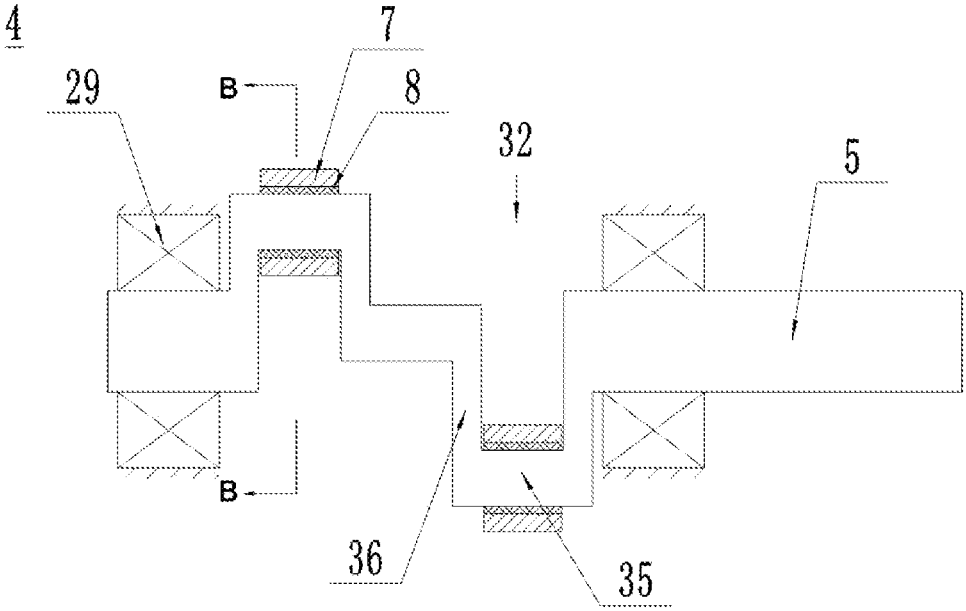
FIG. 4 is a schematic view of the driving mechanism (embodiment two) according to the present disclosure.
Figure 5:
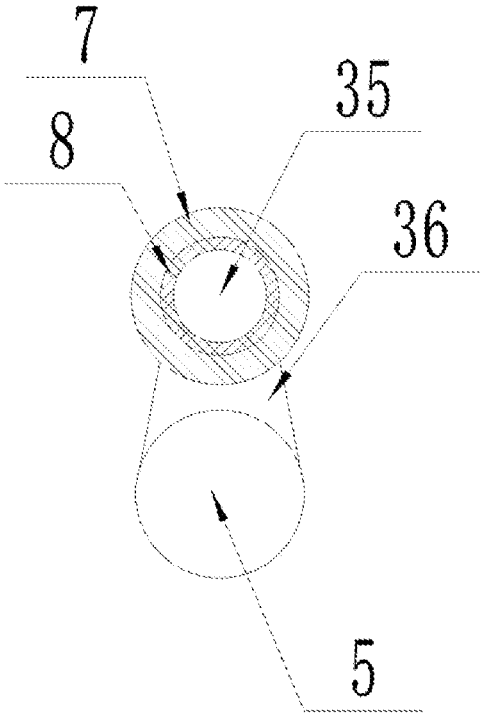
FIG. 5 is a cross-sectional view B-B of FIG. 4 (embodiment two).

As shown in FIGS. 4-5, the difference between this embodiment and the embodiment one is that: in this embodiment, the eccentric structure 32 is a crankshaft, the connecting rod journals 35 are connected to the main shaft 5 through cranks 36, the thrust structure 7 is sleeved on the peripheries of the connecting rod journals 35, and the first anti-friction layer 8 is disposed on the outer surfaces of the connecting rod journals 35 and/or the inner surfaces of the thrust structure 7.

Embodiment Three

Figure 6:
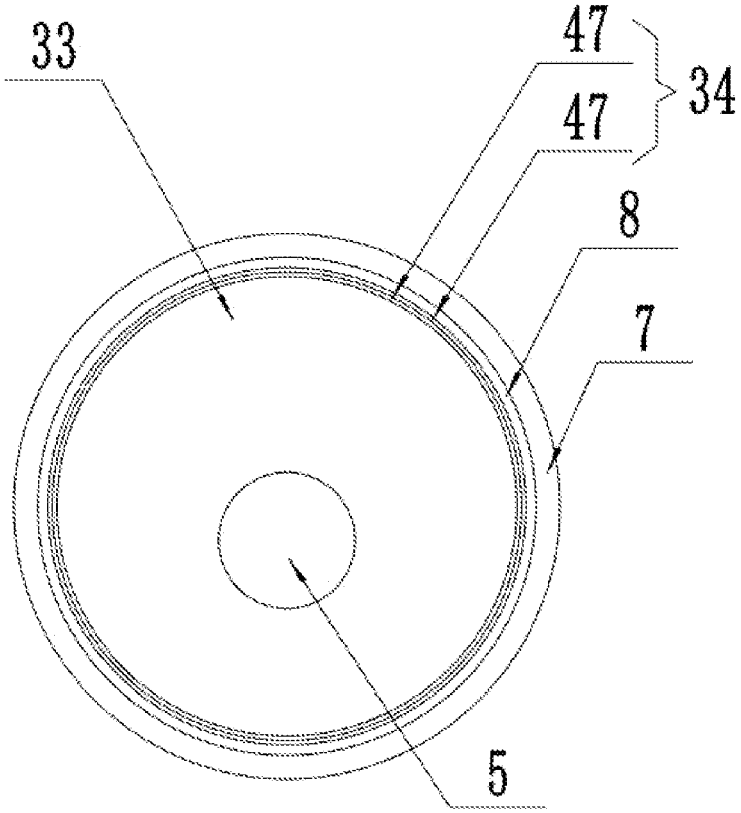
FIG. 6 is a schematic view of the eccentric structure (embodiment three) according to the present disclosure.

As shown in FIG. 6, the difference between this embodiment and the embodiment one is that: in this embodiment, the eccentric structure 32 includes a main body 33 and a sleeve connection structure 34, the sleeve connection structure 34 is sleeved on the main body 33, and a gap is provided between the sleeve connection structure 34 and the main body 33. The thrust structure 7 is sleeved outside the sleeve connection structure 34, and the outer surface of the sleeve connection structure 34 and/or the inner surface of the thrust structure 7 are/is provided with the first anti-friction layer 8. The thrust structure 7 and the sleeve connection structure 34 can rotate with each other.

The sleeve connection structure 34 can also be composed of at least two sleeve connection bodies 47 which are sequentially sleeved, an innermost sleeve connection body 47 is sleeved on the main body 33, a gap is provided between the innermost sleeve connection body 47 and the main body 33, and a gap is provided between adjacent sleeve connection bodies 47.

Embodiment Four

Figure 7:
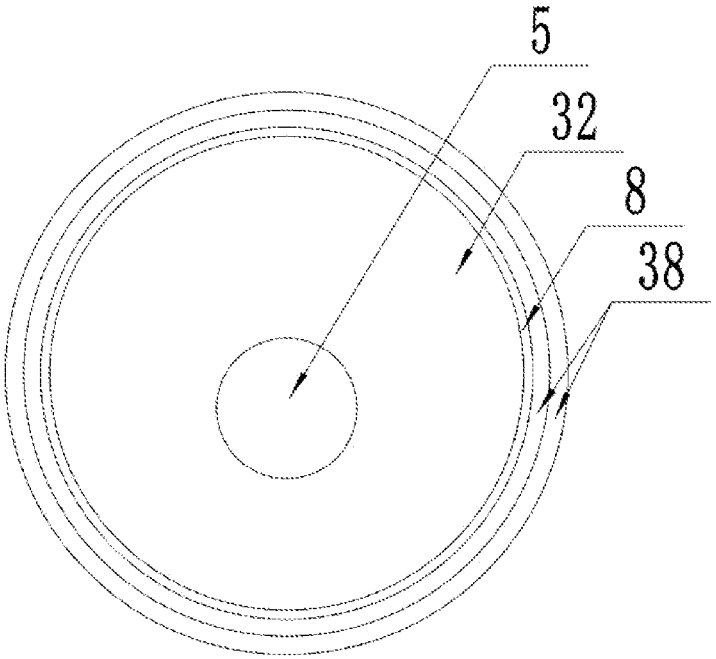
FIG. 7 is a schematic view of the thrust structure (embodiment four) according to the present disclosure.

As shown in FIG. 7, the difference between this embodiment and the embodiment one is that: the thrust structure 7 includes at least two thrust bodies 38 which are sequentially sleeved, an innermost thrust body 38 is sleeved on the eccentric structure 32, a gap is arranged between the innermost thrust body 38 and the eccentric structure 32, and a gap is arranged between the adjacent thrust bodies 38. The outer surface of the eccentric configuration 32 and/or the inner surface of the innermost thrust body 38 are/is provided with a first anti-friction layer 8.

Embodiment Five

For the embodiment one, when the thrust structure 7 pushes the plunger body 3 to move to the left, the contact position of the force between the thrust structure 7 and the plunger body 3 varies with the rotation angle. When the contact position is not at the center position of the plunger body 3, a bending moment load is applied to the plunger body 3, and the bending moment load increases as the contact position deviates from the center position. As the output fluid pressure of the pump increases, the bending moment to which the plunger body 3 is subjected becomes more severe, and the stress of the second friction pairs significantly increases, thereby possibly leading to rapid failure of the second friction pair. By introducing a tappet 49 with a larger diameter to bear the main bending moment load, the bending moment load borne by the plunger 43 is greatly reduced, which can effectively solve this problem and further improve the output pressure of the water pump.

Figure 8:
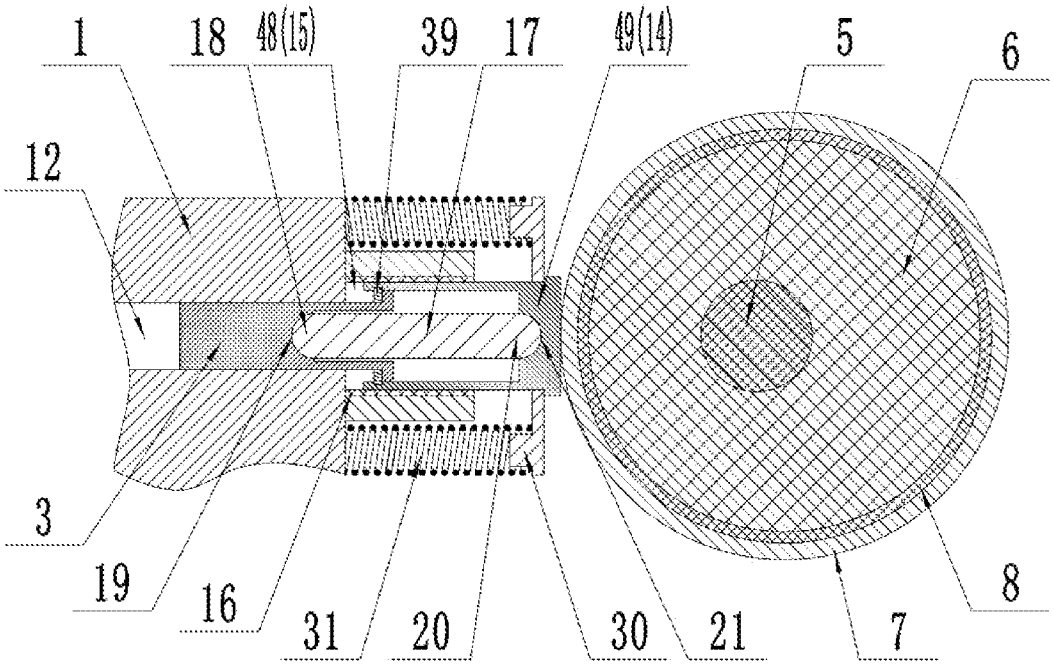
FIG. 8 is a cross-sectional view of the high-pressure water pump lubricated by water or aqueous solution (embodiment five) according to the present disclosure.

As shown in FIG. 8, the difference between this embodiment and the embodiment one is that: in this embodiment, the plunger 43 includes a plunger body 3 and a tappet 49, the tappet 49 in this embodiment is the first tappet 14, and a ball head rod 17 is arranged between the plunger body 3 and the first tappet 14. A first ball head 18 at one end of the ball head rod 17 is disposed in a first ball socket 19 of the plunger body 3, and the first ball head 18 and/or the first ball socket 19 are/is provided with an anti-friction layer. A second ball head 20 at the other end of the ball head rod 17 is disposed in a second ball socket 21 of the first tappet 14, the second ball head 20 and/or the second ball socket 21 are/is provided with an anti-friction layer, the first ball 18 and the second ball 20 can rotate in the first ball socket 19 and the second ball socket 21, respectively.

The right end of the first tappet 14 is abutted against the thrust structure 7, the first tappet 14 can slide in a tappet cavity 48 on the liquid cylinder body 1 or the shell 2, and the tappet cavity 48 of this embodiment is the first tappet cavity 15. The first tappet 14 and the first tappet cavity 15 constitute a third friction pair, and the outer surface of the first tappet 14 and/or the inner surface of the first tappet cavity 15 are/is provided with a third anti-friction layer 16. When the thrust structure 7 pushes the first tappet 14 to move in the direction of the liquid cylinder body 1, the first tappet 14 further transmits a force to the plunger body 3 through the ball head rod 17, so that the plunger body 3 moves in the plunger cavity 12 and realizes a pressure boost to the water or aqueous solution.

In this embodiment, the third anti-friction layer 16 is made of plastic, preferably thermoplastic materials, such as polyether ether ketone, polyphenylene sulfide, polyamide, polyarylene ether, etc., and the tribological properties can be effectively improved by adding fiber, graphite, polytetrafluoroethylene, etc. into the plastic. The third anti-friction layer may be fixed by bonding or interference fit, or may be directly formed on an inner wall of the first tappet cavity 15 and/or an outer cylindrical surface of the first tappet 14 by injection molding or spraying.

In this embodiment, the rebound structure 9 includes a second baffle 30 and a second elastic element 31, the second baffle 30 is fixed to one end of the first tappet 14, one end of the second elastic element 31 abuts against the liquid cylinder body 1, and the other end of the second elastic element 31 abuts against the second baffle 30. The main shaft 5 drives the cam 6 to rotate, and when the cam 6 rotates, the thrust structure 7 pushes the first tappet 14 to move towards the direction of the liquid cylinder body 1 through contact. By the action of the resilient structure 9, it is ensured that the first tappet 14 is always in contact with the thrust structure 7 while being in the return process.

In this embodiment, a groove is formed in an inner wall of the first tappet 14, a stop ring 39 is placed in the groove, the bottom of the plunger body 3 is protruded, the protrusion of the bottom of the plunger body 3 and the first tappet 14 are limited by the stop ring 39, it is ensured that in the return process of the plunger 43, the plunger body 3 can move in the direction away from the liquid cylinder body 1 along with the first tappet 14, and the first ball head 18 and the second ball head 20 at the two ends of the ball head rod 17 are respectively kept in the first ball socket 19 and the second ball socket 21.

In this embodiment, the plunger body 3 is installed in the plunger cavity 12, and there is a small gap (for example, a gap of 1-20 μm) between the plunger body 3 and the inner surface of the plunger cavity 12, so that the plunger body 3 can reciprocate in the plunger cavity 12. When the plunger body 3 moves in a direction away from the liquid cylinder body 1, the plunger cavity 12 sucks in the fluid. When the plunger body 3 moves in the direction of the liquid cylinder body 1, the fluid is pressurized and discharged. The outer surface of the plunger body 3 and the inner surface of the plunger cavity 12 constitute a sliding friction pair, and the outer surface of the plunger body 3, or the inner surface of the plunger cavity 12, or both the outer surface of the plunger body 3 and the inner surface of the plunger cavity 12 is/are provided with the anti-friction layers.

In this embodiment, the material of the anti-friction layer is preferably DLC (diamond-like carbon), which has a good anti-friction effect.

In this embodiment, when the thrust structure 7 pushes the first tappet 14 to move to the left, the contact position of the force between the thrust structure 7 and the first tappet 14 varies with the rotation angle. When the contact position is not at a center position of the first tappet 14, a bending moment load is applied to the first tappet 14, and the bending moment load increases as the contact position deviates from the center position. In this embodiment, the first tappet 14 bears the main bending moment load and undergoes microscopic deformation. The deformation of the first tappet 14 caused by the load and the misalignment caused by the machining and assembly errors between the first tappet 14 and the plunger body 3 are coordinated through the ball head rod 17. When the fluid is pressurized, the acting force of the ball head rod 17 on the plunger body 3 is mainly thrust along the axis direction of the plunger body 3, the bending load is greatly reduced, the friction force between the plunger 43 and the plunger cavity 12 is also greatly reduced, and the long-life operation of the plunger body 3 is ensured.

In this embodiment, the components having the friction pair with the DLC films can also be directly implemented by using the components with a ceramic material or a cemented carbide material as a whole or as a friction surface.

This embodiment has a simple structure and can achieve a pressure output exceeding 50 MPa.

Embodiment Six

Figure 9:
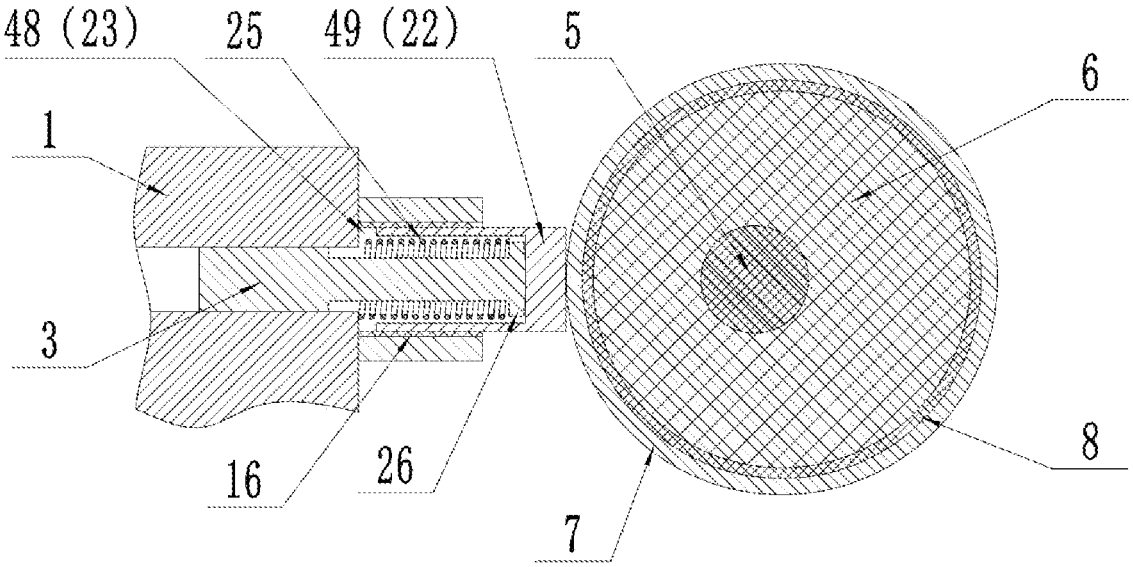
FIG. 9 is a cross-sectional view of the high-pressure water pump lubricated by water or aqueous solution (embodiment six) according to the present disclosure.

As shown in FIG. 9, the difference between this embodiment and the embodiment five is that: in this embodiment, the tappet 49 is the second tappet 22, and the tappet cavity 48 is the second tappet cavity 23. In this embodiment, one end of the plunger body 3 abuts against the inner surface of the second tappet 22, and the contact surface is an arc surface. This configuration also enables the second tappet 22 to carry the main bending moment load during operation, helping to reduce the forces between the plunger 43 and the plunger cavity 12 when the plunger body 3 and the second tappet 22 are not coaxial. The right end surface of the plunger body 3 and/or the inner surface of the second tappet 22 are provided with an anti-friction layer.

In this embodiment, the rebound structure 9 includes a third elastic element 25, the third elastic element 25 is sleeved on the plunger body 3, one end of the third elastic element 25 abuts against the liquid cylinder body 1, the other end of the third elastic element 25 abuts against a boss 26 at one end of the plunger body 3, and the plunger body 3 is pressed against the inner surface of the second tappet 22 through the third elastic element 25.

Same as the embodiment five, the outer surface of the plunger body 3, or the inner surface of the plunger cavity 12, or both the outer surface of the plunger body 3 and the inner surface of the plunger cavity 12 is/are provided with the anti-friction layers.

The material of the anti-friction layer is preferably DLC (diamond-like carbon).

Same as the embodiment five, the components having the friction pair with the DLC films can also be directly implemented by using the components with a ceramic material or a cemented carbide material as a whole or as a friction surface.

Same as the embodiment five, an outer surface of the second tappet 22 and/or an inner surface of the tappet cavity 23 are/is provided with a third anti-friction layer 16 of the same material.

Embodiment Seven

Figure 10:
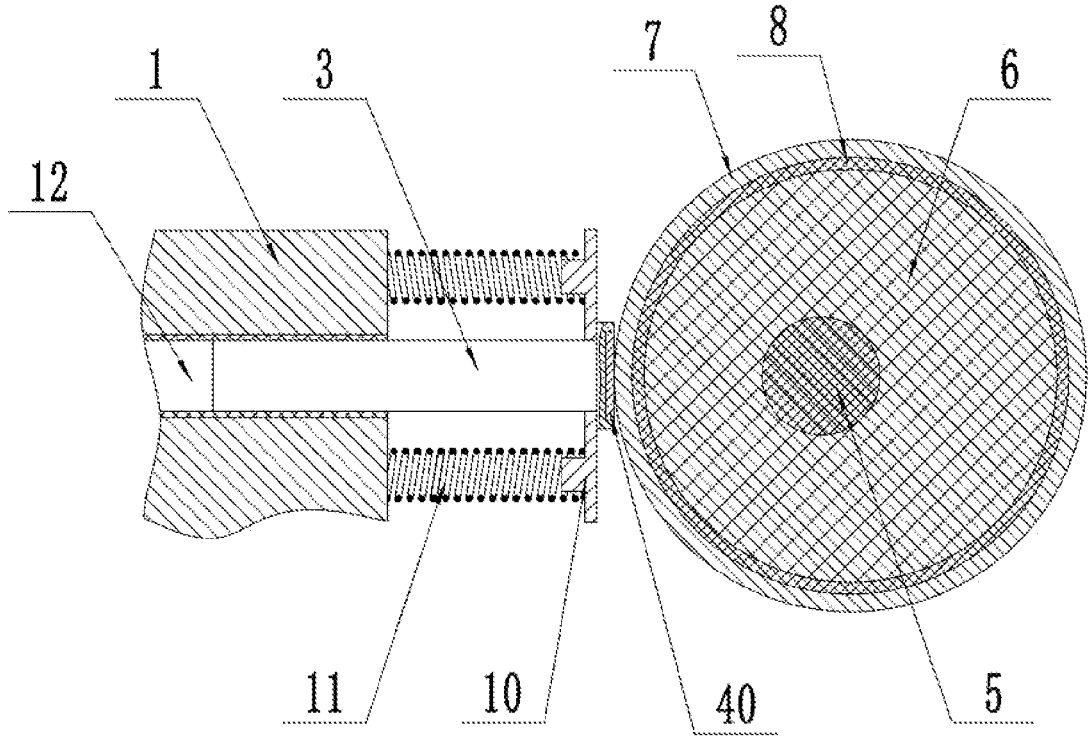
FIG. 10 is a cross-sectional view of the high-pressure water pump lubricated by water or aqueous solution (embodiment seven) according to the present disclosure.

As shown in FIG. 10, the difference between this embodiment and the embodiment one is that: in this embodiment, the plunger 43 is constituted by combining separate parts, the plunger 43 further includes a first plunger body 40, the first plunger body 40 in this embodiment is a wear-resistant sheet, the wear-resistant sheet is connected to the right end of the plunger body 3, the plunger body 3 is located in the plunger cavity 12, the plunger body 3 realizes a pressurization function in the plunger cavity 12, the wear-resistant sheet is in contact with the thrust structure 7, and the force applied to the wear-resistant sheet by the thrust structure 7 is transmitted to the plunger body 3. The plunger body 3 and the wear-resistant sheet are made of different materials, and the wear-resistant sheet is composed of friction wear resistant and contact fatigue resistant materials with relatively high hardness, preferably ceramic, hard alloy, martensitic stainless steel, high nitrogen stainless steel, etc.

The principle and the implementation mode of the present disclosure are explained by applying specific examples in the present specification, and the above descriptions of the examples are only used to help understanding the method and the core idea of the present disclosure; Furthermore, for a person skilled in the art, according to the idea of the present disclosure, the specific embodiments and the application range may be changed. In view of the above, the present disclosure should not be construed as limiting the present disclosure.

What is claimed is:

1. A high-pressure water pump lubricated by water or aqueous solution, comprising a driving mechanism without a hydrostatic support, a shell, a rebound structure, at least one plunger and a plunger cavity, wherein the driving mechanism comprises a main shaft and at least one eccentric structure arranged on the main shaft, a thrust structure is sleeved on an outer side of each eccentric structure, the thrust structure and the eccentric structure rotate relative to each other, and the thrust structure and the eccentric structure constitute a first sliding friction pair to reduce friction through a hydrodynamic pressure lubrication effect generated by the mutual rotation of the eccentric structure and the thrust structure with water or aqueous solution as lubricant; the eccentric structure and the thrust structure are both located in the shell, spaces in the shell in which the eccentric structure and the thrust structure are respectively located are used to be filled with water or an aqueous solution simultaneously, and the water or aqueous solution enters the first sliding friction pair in the shell; when the eccentric structure is rotated, the thrust structure rolls on a contact surface between the thrust structure and the plunger by adopting a rolling contact between the thrust structure and the plunger in water environment condition and pushes the plunger to move in the plunger cavity to pressurize the water or aqueous solution; and the plunger moves in the plunger cavity under the rebound force of the rebound structure to suck in water or aqueous solution; wherein a first anti-friction layer is provided on the outer surface of the eccentric structure and/or the inner surface of the thrust structure, and the first anti-friction layer is made of plastic.

2. The high-pressure water pump lubricated by water or aqueous solution according to claim 1, wherein an outer edge curve of a cross section of the thrust structure perpendicular to an axis of the main shaft comprises a first curve and a second curve, a perpendicular distance from a point on the first curve to the axis of the main shaft gradually increases from one end of the first curve to another end of the first curve, and a perpendicular distance from a point on the second curve to the axis of the main shaft gradually decreases from one end of the second curve, which is connected to said another end of the first curve, to another end of the second curve which is connected to said one end of the first curve.

3. The high-pressure water pump lubricated by water or aqueous solution according to claim 1, wherein the plunger comprises a plunger body, one end of the plunger body extends into the plunger cavity, the plunger body and the plunger cavity constitute a second friction pair, a second anti-friction layer is fixed on an outer surface of the plunger body and/or an inner surface of the plunger cavity; and the second anti-friction layer is made of plastic.

4. The high-pressure water pump lubricated by water or aqueous solution according to claim 3, wherein the high-pressure water pump lubricated by water or aqueous solution comprises at least two thrust structures and at least two plungers, the at least two thrust structures and the at least two plungers correspond to each other one by one, and the at least two plungers are located at one side of the main shaft.

5. The high-pressure water pump lubricated by water or aqueous solution according to claim 1, wherein the eccentric structure comprises a main body and a sleeve connection structure, the sleeve connection structure is sleeved on the main body, and a gap is provided between the sleeve connection structure and the main body.

6. The high-pressure water pump lubricated by water or aqueous solution according to claim 5, wherein the sleeve connection structure comprises at least two sleeve connection bodies which are sequentially sleeved, a gap is provided between the innermost sleeve connection body and the main body, and a gap is provided between adjacent sleeve connection bodies.

7. The high-pressure water pump lubricated by water or aqueous solution according to claim 1, wherein the thrust structure comprises at least two thrust bodies which are sequentially sleeved, an innermost thrust body is sleeved on the eccentric structure, a gap is arranged between the innermost thrust body and the eccentric structure, and a gap is arranged between adjacent thrust bodies.

8. The high-pressure water pump lubricated by water or aqueous solution according to claim 1, further comprising a tappet cavity, wherein the plunger comprises a plunger body and a tappet, the tappet slides in the tappet cavity, the tappet and the tappet cavity constitute a third friction pair, an outer surface of the tappet and/or an inner surface of the tappet cavity are/is fixed with a third anti-friction layer, the third anti-friction layer is made of plastic; the thrust structure pushes the tappet to move in the tappet cavity, the tappet transmits a force of the thrust structure to the plunger body, so that the plunger body moves in the plunger cavity and realizes a pressure boost to the water or aqueous solution.

9. The high-pressure water pump lubricated by water or aqueous solution according to claim 3, wherein the plunger further comprises a first plunger body, the first plunger body is arranged on one side of the plunger body, the first plunger body is in contact with the thrust structure, and the first plunger body and the plunger body are made of different materials.

* * * * *